US011434724B2

(12) United States Patent
Hidaka et al.

(10) Patent No.: US 11,434,724 B2
(45) Date of Patent: Sep. 6, 2022

(54) APPARATUS, METHOD, AND PROGRAM FOR ESTIMATING A STATE OF A NATURAL RESOURCE TO BE EXTRACTED

(71) Applicant: YOKOGAWA ELECTRIC CORPORATION, Tokyo (JP)

(72) Inventors: Yoshihisa Hidaka, Tokyo (JP); Nobuo Okabe, Tokyo (JP); Naoki Yoshima, Tokyo (JP)

(73) Assignee: Yokogawa Electric Corporation, Tokyo (JP)

( * ) Notice: Subject to any disclaimer, the term of this patent is extended or adjusted under 35 U.S.C. 154(b) by 0 days.

(21) Appl. No.: 17/128,245

(22) Filed: Dec. 21, 2020

(65) Prior Publication Data

US 2021/0108488 A1 Apr. 15, 2021

Related U.S. Application Data

(63) Continuation of application No. PCT/JP2019/027061, filed on Jul. 8, 2019.

(30) Foreign Application Priority Data

Jul. 13, 2018 (JP) ..... JP2018-133509

(51) Int. Cl.
*E21B 37/06* (2006.01)
*E21B 47/07* (2012.01)
(Continued)

(52) U.S. Cl.
CPC ..... *E21B 37/06* (2013.01); *E21B 36/00* (2013.01); *E21B 47/06* (2013.01); *E21B 47/07* (2020.05); *E21B 33/035* (2013.01); *E21B 43/01* (2013.01)

(58) Field of Classification Search
CPC ..... E21B 37/06
See application file for complete search history.

(56) References Cited

U.S. PATENT DOCUMENTS 6,268,911 B1 * 7/2001 Tubel ..... E21B 41/02 356/72
6,880,402 B1 * 4/2005 Couet ..... B08B 3/12 73/579
(Continued)

OTHER PUBLICATIONS

JOGMEC Petroleum Development Technology Division, "Technical Issues Related to Oil and Natural Gas Development—What Is the Latest Technology to Overcome?—" Oil and Natural Gas review, Jan. 2014, vol. 48,No. 1, pp. 33-75.
(Continued)

*Primary Examiner* — Kenneth L Thompson

(57) ABSTRACT

To estimate a state of a natural resource in pipeline equipment during extraction in an oil field, provided is an apparatus including a data acquiring section that acquires measurement data, measured by a measurement device, indicating a state of a natural resource that is a fluid flowing through an extraction network for extracting the natural resource; a state estimating section that estimates the state of the natural resource at least at one location differing from a location where the measurement device is provided in a flow path of the extraction network, using the measurement data and a model of the extraction network; and a margin calculating section that calculates a margin until flow path blocking matter is generated in the extraction network, based on the estimated state of the natural resource.

15 Claims, 8 Drawing Sheets

(51) Int. Cl.

| | |
|---|---|
| ***E21B 36/00*** | (2006.01) |
| ***E21B 47/06*** | (2012.01) |
| *E21B 33/035* | (2006.01) |
| *E21B 43/01* | (2006.01) |

(56) References Cited

U.S. PATENT DOCUMENTS

| | | | | |
|---|---|---|---|---|
| 7,389,787 | B2 * | 6/2008 | Means | E21B 37/06 137/13 |
| 8,430,162 | B2 * | 4/2013 | Kotsonis | E21B 37/06 166/250.05 |
| 9,399,899 | B2 * | 7/2016 | Stoisits | C09K 8/52 |
| 10,323,512 | B2 * | 6/2019 | Duchene | E21B 49/081 |
| 10,400,580 | B2 * | 9/2019 | Guelat | E21B 47/07 |
| 2012/0160329 | A1 * | 6/2012 | MacKenzie | E21B 47/001 137/1 |
| 2016/0115395 | A1 | 4/2016 | Rustad | |

OTHER PUBLICATIONS

International Search Report and (ISA/237) Written Opinion of the International Search Authority for International Patent Application No. PCT/JP2019/027061, issued/mailed by the Japan Patent Office dated Sep. 30, 2019.

* cited by examiner

10

400

APPARATUS, METHOD, AND PROGRAM FOR ESTIMATING A STATE OF A NATURAL RESOURCE TO BE EXTRACTED

CROSS-REFERENCE TO RELATED APPLICATION

This is a continuation application of International Application No. PCT/JP2019/027061, filed on Jul. 8, 2019, which claims priority to Japanese Patent Application No. 2018-133509, filed on Jul. 13, 2018, the contents of each of which are incorporated herein by reference.

BACKGROUND

1. Technical Field

The present invention relates to an apparatus, a method, and a program for estimating a state of a natural resource to be extracted.

2. Related Art

A natural resource such as crude oil or natural gas extracted from a wellhead on a well side is transported to an offshore platform or the like using pipeline equipment including a flowline, a manifold, and the like. Conventional strategies, such as MEG injection for injecting MEG (Monoethylene Glycol) on the wellhead side, are known for preventing blockage of the flow caused by the natural resource becoming hydrated or the like within the pipeline equipment, as shown in Non-Patent Document 1, for example.

Non-Patent Document 1: JOGMEC Petroleum Development Technology Division, "Technical Issues Related to Oil and Natural Gas Development—What Is the Latest Technology to Overcome?—" Oil and Natural Gas review, January, 2014, Vol. 48, No. 1, pp. 33-75

SUMMARY

Conventionally, it is impossible to know the state of the natural resource within the pipeline equipment during operation of the oil field and to know changes in the oil field, and therefore the amount of the MEG injection or the like is determined based on the experience of an engineer or the like. As a result, there is a tendency for risks such as hydration to be overestimated, and so that an excessive amount of MEG injection or the like is performed.

According to a first aspect of the present invention, provided is an apparatus. The apparatus may comprise a data acquiring section that acquires measurement data, measured by a measurement device, indicating a state of a natural resource that is a fluid flowing through an extraction network for extracting the natural resource. The apparatus may comprise a state estimating section that estimates the state of the natural resource at least at one location differing from a location where the measurement device is provided in a flow path of the extraction network, using the measurement data and a model of the extraction network. The apparatus may comprise a margin calculating section that calculates a margin until flow path blocking matter is generated in the extraction network, based on the estimated state of the natural resource.

According to a second aspect of the present invention, provided is a method. The method may comprise acquiring, by a computer, measurement data, measured by a measurement device, indicating a state of a natural resource that is a fluid flowing through an extraction network for extracting the natural resource. The method may comprise estimating, with the computer, the state of the natural resource at least at one location differing from a location where the measurement device is provided in a flow path of the extraction network, using the measurement data and a model of the extraction network. The method may comprise calculating, with the computer, a margin until flow path blocking matter is generated in the extraction network, based on the estimated state of the natural resource.

According to a third aspect of the present invention, provided is a program that is executed by a computer. The program may cause the computer to function as a data acquiring section that acquires measurement data, measured by a measurement device, indicating a state of a natural resource that is a fluid flowing through an extraction network for extracting the natural resource. The program may cause the computer to function as a state estimating section that estimates the state of the natural resource at least at one location differing from a location where the measurement device is provided in a flow path of the extraction network, using the measurement data and a model of the extraction network. The program may cause the computer to function as a margin calculating section that calculates a margin until flow path blocking matter is generated in the extraction network, based on the estimated state of the natural resource.

The summary clause does not necessarily describe all necessary features of the embodiments of the present invention. The present invention may also be a sub-combination of the features described above.

DESCRIPTION OF EXEMPLARY EMBODIMENTS

Hereinafter, some embodiments of the present invention will be described. The embodiments do not limit the invention according to the claims, and all the combinations of the features described in the embodiments are not necessarily essential to means provided by aspects of the invention.

Figure 1:
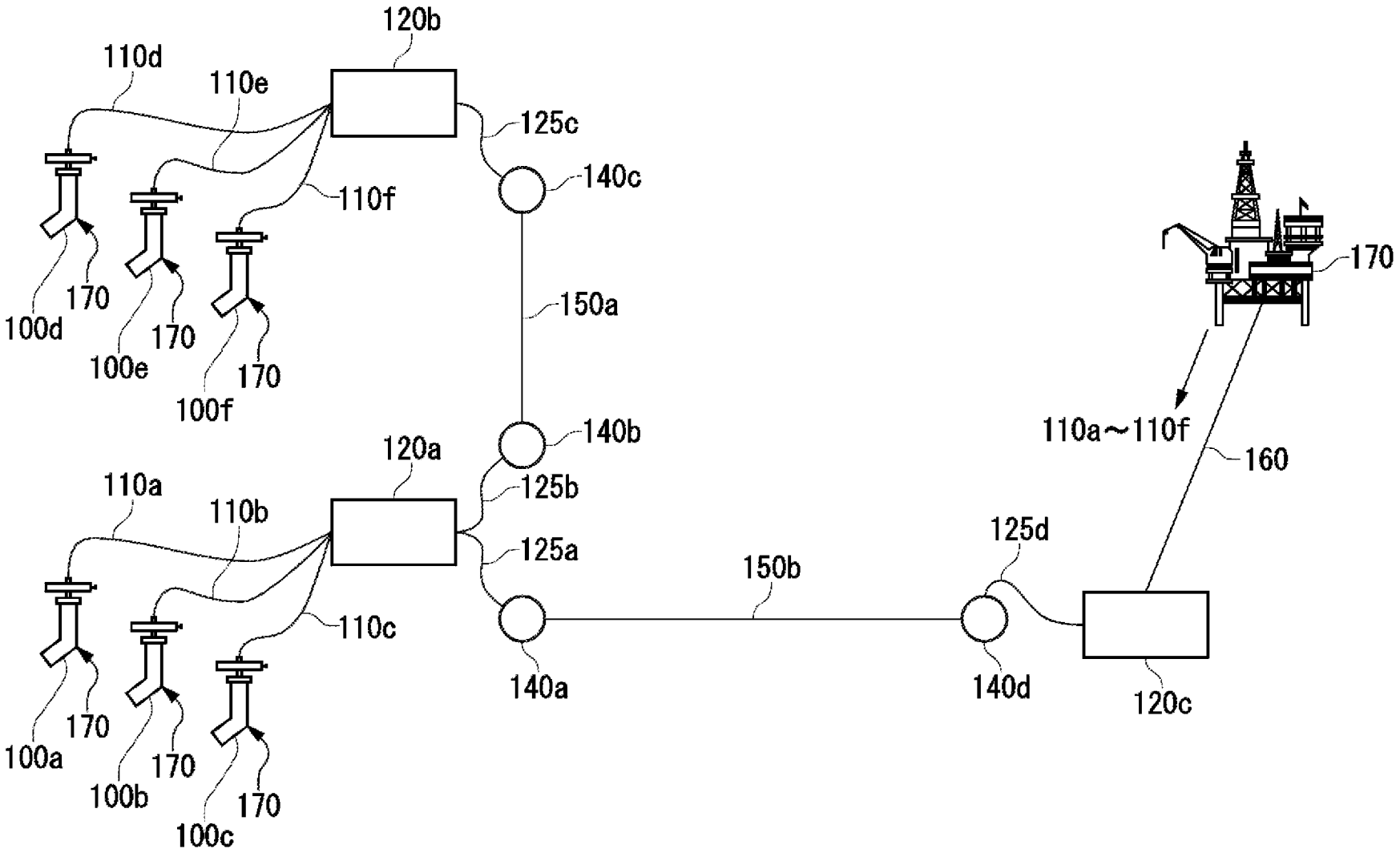
FIG. 1 shows an example of an extraction network 10 for a natural resource.

FIG. 1 shows an example of an extraction network 10 for a natural resource. The extraction network 10 acquires a natural resource such as crude oil or natural gas flowing in from a well side, by transporting the extracted natural resource through pipeline equipment. In the present example, the extraction network 10 transports the natural resource from a well on the ocean floor to an offshore facility. The extraction network 10 includes a plurality of wellheads 100*a* to 100*f*, a plurality of jumpers 110*a* to 110*f*, a plurality of manifolds 120*a* to 120*c*, a plurality of jumpers 125*a* to 125*d*, a plurality of PLEMs 140*a* to 140*d*, a plurality of flowlines 150*a* and 150*b*, a riser 160, and a platform 170.

Each of the plurality of wellheads 100*a* to 100*f* (also referred to below as the "wellheads 100") extends from the surface of the ocean floor to a stratum containing the natural resource, and extracts the natural resource from the reservoir.

Each of the plurality of jumpers 110*a* to 110*f* (also referred to below as the "jumpers 110") is a pipeline that is installed on the ocean floor, has one end connected to a corresponding wellhead 100*a* to 100*f*, and has the other end connected to one of the plurality of manifolds 120*a* to 120*b*. The jumpers 110*a* to 110*f* may be flexible pipes that can bend according to routing on the ocean floor. Each jumper 110 functions as a flow path through which the natural resource extracted by the wellhead 100 connected thereto flows.

Among the plurality of manifolds 120*a* to 120*c* (also referred to below as the "manifolds 120"), the manifolds 120*a* and 120*b* are each a piping structure that is installed on the ocean floor and causes the natural resource flowing in from the plurality of wellheads 100 to merge and flow to the jumper 125*a* or the jumper 125*c* on a downstream side thereof. In the present example, the manifold 120*a* connects the jumpers 110*a* to 110*c* to the jumper 125*a*. Furthermore, the manifold 120*a* is connected to the jumper 125*b* through which the natural resource flowing in from the wellheads 100*d* and 100*f* flow, and causes the natural resource flowing in from the jumper 125*b* to flow to the jumper 125*a*. The manifold 120*b* connects the jumpers 110*d* and 110*f* to the jumper 125*c*.

The manifold 120*c* is a piping structure that is installed on the ocean floor and causes the natural resource flowing in from the jumper 125*d* to flow to the riser 160 on a downstream side thereof. In the present example, the manifold 120*c* functions as a connection point for connecting the jumper 125*d* to the riser 160.

Each of the plurality of jumpers 125*a* to 125*d* (also referred to below as the "jumpers 125") is a pipe that is installed on the ocean floor, has one end connected to one of the manifolds 120*a* to 120*c*, and has the other end connected to one of the PLEMs 140*a* to 140*d*. The jumpers 125*a* to 125*d* may be flexible pipes that can bend according to routing on the ocean floor. The jumper 125*a* functions as a flow path through which the natural resource merged by the manifold 120*a* connected thereto flows to the PLEM 140*a*. The jumper 125*b* functions as a flow path through which the natural resource flowing in from the PLEM 140*b* connected thereto flows to the manifold 120*a*. The jumper 125*c* functions as a flow path through which the natural resource merged by the manifold 120*c* connected thereto flows to the PLEM 140*c*. The jumper 125*d* functions as a flow path through which the natural resource flowing in from the PLEM 140*d* connected thereto flows to the manifold 120*c*.

The PLEMs 140*a* to 140*d* (Pipeline End Manifolds, also referred to below as the "PLEMs 140") are one type of manifold, and are piping structures or joints that are provided at the ends of the flowlines 150*a* and 150*b* that are pipelines that are more resistant to bending than the jumpers 110 and the jumpers 125, in order to connect the flowlines 150*a* and 150*b* to the jumpers 125*a* to 125*d*. In the present example, the PLEM 140*a* connects the jumper 125*a* to the flowline 150*b*, the PLEM 140*b* connects the flowline 150*a* to the jumper 125*b*, the PLEM 140*c* connects the jumper 125*c* to the flowline 150*a*, and the PLEM 140*d* connects the flowline 150*b* to the manifold 120*c*.

Among the plurality of flowlines 150*a* and 150*b* (also referred to below as the "flowlines 150"), the flowline 150*a* is a pipeline that is installed on the ocean floor, has one end connected to the PLEM 140*c*, and has the other end connected to the PLEM 140*b*. The flowline 150*b* is a pipeline that is installed on the ocean floor, has one end connected to the PLEM 140*a*, and has the other end connected to the PLEM 140*d*. Each flowline 150 functions as a flow path through which the natural resource flowing in from the PLEM 140 at one end thereof flows to the PLEM 140 at the other end thereof. Each flowline 150 may be a steel pipe or the like that has a certain degree of elasticity and is resistant to bending and impacts due to earthquakes or the like, while being more resistant to bending than the jumpers 110 and the jumpers 125.

The riser 160 is a pipeline that has one end thereof on the ocean floor side connected to the manifold 120*c*, and guides the natural resources that have flowed through the flowline 150*b* along the ocean floor to the offshore portion of the platform 170. The riser 160 includes a natural resource outlet at the other end there on the platform 170 side.

The platform 170 is a structure for offshore recovery of the natural resources output from the riser 160. In the present drawing, the platform 170 is a fixed platform that has a leg portion secured to the ocean floor, for example. Instead, the platform 170 may be a floating platform. The platform 170 may include a production facility that processes the natural resource to produce at least one of oil and gas, and may include a storage tank or the like that stores the natural resource or the produced oil or the like. Furthermore, the platform 170 may include facilities (living quarters, a heliport, or the like) used by workers involved in the extraction of the natural resource and the production of oil or the like.

In the above description, an example is shown in which the extraction network 10 gathers a natural resource extracted from the ocean floor at the platform 170 on the ocean surface (offshore example), but instead, the extraction network 10 may collect a natural resource extracted from the ocean floor at a plant provided on land on a coast (offshore extraction of natural resources and onshore collection), or may transport and collect on the land a natural resource extracted from an oil field or the like, which is on the land (onshore extraction and collection of natural resources).

In order to extract the natural resource continuously over a long period of time using the extraction network 10, there is a demand to manage the flow paths in a manner to realize flow assurance of the extraction network 10, i.e. to prevent blockage of the flow of the natural resource. To realize the flow assurance, there is a demand for preventing the generation of flow path blocking matter that blocks the flow through the extraction network 10. Examples of such flow path blocking matter include hydrates, waxes, asphaltenes, and scales (see Non-Patent Document 1, for example).

(1) Hydrates

When a condition occurs whereby the natural resource is at a low temperature and high pressure in a flow path of the extraction network 10, the water and gas such as methane contained in the natural resource are hydrated. One example of a known method for inhibiting hydration includes using a chemical injection apparatus such as a MEG injection apparatus to send a chemical substance such as at least one of methanol and glycol (referred to as "MEG") into the wellhead 100 to inject this MEG into the natural resource extracted by the wellhead 100. In the present drawing, the arrows from the platform 170 to each wellhead 100 indicate the flow of the chemical substance used in the chemical injection.

(2) Waxes

When the natural resource in a flow path of the extraction network 10 becomes less than or equal to a specified temperature, wax that has been dissolved in the natural resource is precipitated. Examples of known methods for inhibiting wax precipitation include a method of injecting an inhibitor and a method of heating and maintaining the heat of the pipes in the extraction network 10.

(3) Asphaltenes

When asphaltene precipitation conditions occur in a flow path of the extraction network 10, the asphaltenes contained in the natural resource to be precipitated and aggregated. Known means for inhibiting the precipitation of asphaltenes include a method of raising the temperature of the natural resource, a method of maintaining the pressure of the natural resource to be greater than or equal to the precipitation upper limit, a method of adding an aggregation relaxing agent to the natural resource, and the like.

(4) Scales

When the salinity concentration of the natural resource is high in a flow path of the extraction network 10, scales contained in the natural resource precipitate and stick to the inner walls of the pipes. Known means for inhibiting the precipitation of scales include a method of injecting an inhibitor into the natural resource and the like.

Figure 2:
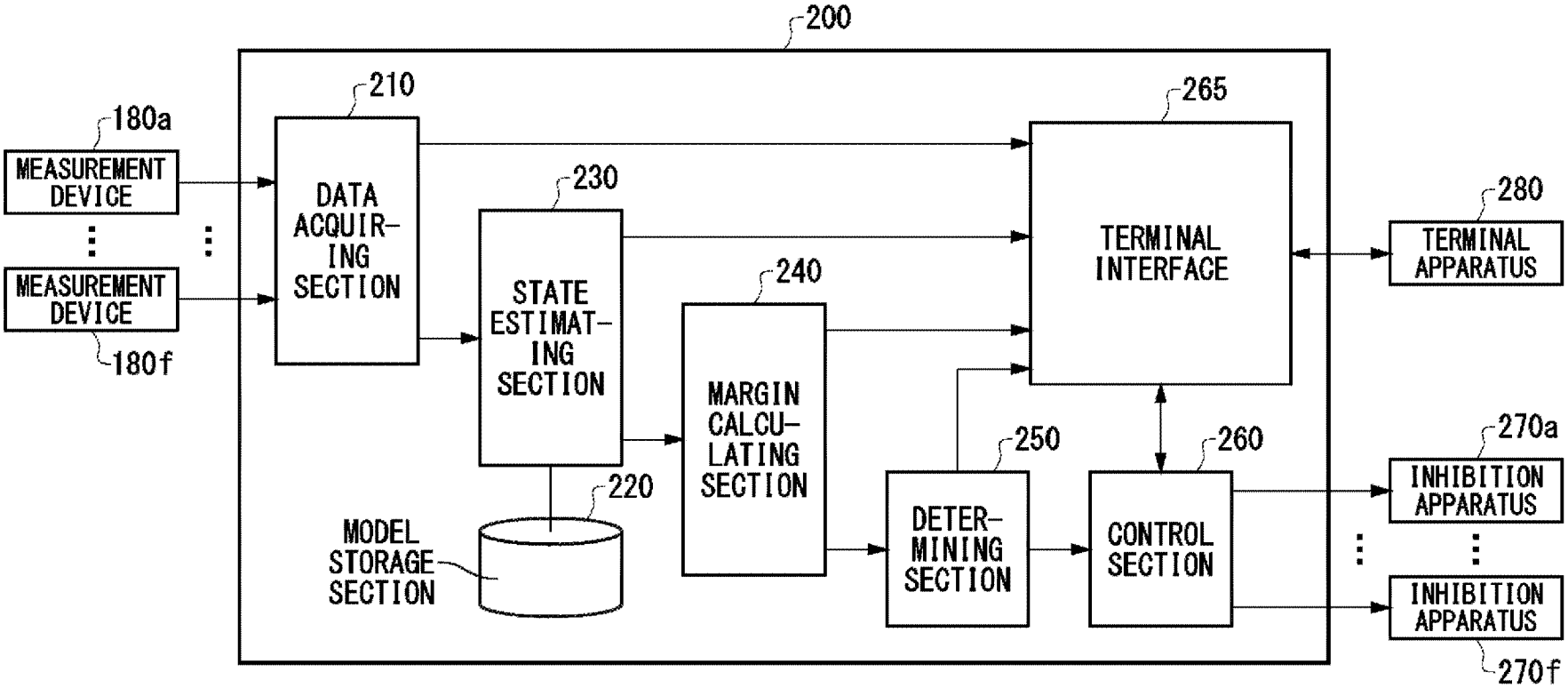
FIG. 2 shows a configuration of an apparatus 200 according to the present embodiment.

FIG. 2 shows a configuration of an apparatus 200 according to the present embodiment, along with one or more measurement devices 180*a* to 180*f* (also referred to as the "measurement devices 180"), one or more inhibition apparatuses 270*a* to 270*f* (also referred to as the "inhibition apparatuses 270"), and a terminal apparatus 280. The apparatus 200 uses the state of the natural resource within the extraction network 10, as measured by the one or more measurement devices 180, to estimate the state of the natural resource at another location in the extraction network 10 and a margin until the generation of flow path blocking matter. The apparatus 200 then causes the one or more inhibition apparatuses 270 to operate to inhibit the generation of the flow path blocking matter, based on the estimated margin.

Each of the one or more measurement devices 180 is provided at a measurement target location in the flow paths of the extraction network 10, measures the state of the natural resource flowing through the extraction network 10, and outputs measurement data indicating the state of the natural resource. In the present embodiment, each measurement device 180 is provided to a corresponding wellhead 100*a* to 100*f* and measures the state of the natural resource flowing into this wellhead 100, as the state of the natural resource. Each measurement device 180 may measure at least one of the pressure, temperature, component or component ratio, water content, salinity, content ratio of a chemical substance injected by chemical injection, and flow rate of the natural resource.

The apparatus 200 receives the measurement data from each measurement device 180, estimates the state of the natural resource within the extraction network 10, and controls each inhibition apparatus 270 according to the estimation results. The apparatus 200 may be implemented by a computer such as a PC (personal computer), a tablet computer, a smart phone, a work station, a server computer, or a general use computer, or may be realized by a computer system in which a plurality of computers are connected. Alternatively, the apparatus 200 may be implemented by one or more virtual computer environments capable of being executed in a computer. Instead, the apparatus 200 may be a specialized computer designed for the use described above, or may be specialized hardware realized by specialized circuitry.

The apparatus 200 may be a stand-alone apparatus that is installed on the platform 170, in a remote pipeline management room, or the like. Instead, the apparatus 200 may be realized by a cloud service that is executed by a cloud computing system that is connected via a network to an apparatus, such as a computer, that is connected to each measurement device 180 and each inhibition apparatus 270 to monitor and control the extraction network 10.

The apparatus 200 includes a data acquiring section 210, a model storage section 220, a state estimating section 230, a margin calculating section 240, a determining section 250, a control section 260, and a terminal interface 265. The data acquiring section 210 acquires the measurement data, measured by the one or more measurement devices 180, indicating the state of the natural resource flowing through the extraction network 10 either directly or via a network.

The model storage section 220 stores a model of the extraction network 10 to be a processing target. The model of the extraction network 10 includes flow path characteristics used to estimate the flow of the natural resource, such as at least one of a connection relationship, pipe diameter, pipe cross-sectional shape, and flow path length, for each segment obtained by segmenting the flow paths of the extraction network 10, for example. Furthermore, the model of the extraction network 10 may include flow path characteristics used to estimate the temperature of the natural resource, such as at least one of pipe material, pipe thickness, pipe thermal conductivity, water depth, and position. Yet further, since the total extension distance of the extraction network 10 is extremely long and the number of measurement devices 180 that can be installed is limited, the model of the extraction network 10 may include, as a fixed parameter, at least one of the state of the natural resource (pressure, temperature, component ratio, and the like) and an environmental condition (temperature outside the pipe and the like) for some locations where a measurement device 180 is not installed.

The state estimating section 230 is connected to the data acquiring section 210 and the model storage section 220, and estimates the state of the natural resource in the flow paths of the extraction network 10 using the measurement data of each measurement device 180 and the model of the extraction network 10 stored in the model storage section 220. The state estimating section 230 may estimate the state of the natural resource at least at one location where a measurement device 180 is not provided. Furthermore, even at a location where a measurement device 180 is provided, the state estimating section 230 may estimate a value of an evaluation item that cannot be measured by this measurement device 180, among the plurality of evaluation items indicating the state of the natural resource.

The margin calculating section 240 is connected to the state estimating section 230, and calculates the margin until flow path blocking matter is generated in the extraction network 10, based on the state of the natural resource estimated by the state estimating section 230. The determining section 250 is connected to the margin calculating section 240, and determines a recommended operational amount of each inhibition apparatus 270 for inhibiting the generation of flow path blocking matter, based on the margin calculated by the margin calculating section 240. The control section 260 is connected to the determining section 250, and performs control to cause each inhibition apparatus 270 to operate with the recommended operational amount determined by the determining section 250.

The terminal interface 265 is connected to at least one of the data acquiring section 210, the state estimating section 230, the margin calculating section 240, the determining section 250, and the control section 260, and provides an input/output interface of the apparatus 200 to the terminal apparatus 280 used by a user such as a manager, engineer, or the like of the extraction network 10.

Each of the one or more inhibition apparatuses 270 has a function to inhibit the generation of flow path blocking matter in the natural resource flowing through the extraction network 10. The flow path blocking matter that is the target of the inhibition by the inhibition apparatus 270 may include at least one of hydrates, asphaltenes, waxes, and scales. Each inhibition apparatus 270 inhibits the generation of flow path blocking matter using a means for at least one of chemical injection, temperature adjustment of the flow paths of the extraction network 10, pressure adjustment in the flow paths of the extraction network 10, and the like. In order to realize this, each inhibition apparatus 270 may be a chemical injection apparatus, a heater apparatus that heats a pipe in the extraction network 10, a valve apparatus such as flow rate control valve or opening/closing valve that adjusts the flow rate of the natural resource flowing through the flow paths in the extraction network 10, or the like, for example.

An inhibition apparatus 270 serving as a chemical injection apparatus may be a MEG injection apparatus that injects MEG into the natural resource, in order to inhibit hydration. Instead, this inhibition apparatus 270 may be a chemical injection apparatus for adding a coherence modifier to the natural resource in order to inhibit the precipitation of asphaltenes or for injecting an inhibitor to inhibit the precipitation of scales. Such an inhibition apparatus 270 includes a pump installed in the platform 170, and causes a chemical substance to flow from the platform 170 into a sub pipeline for chemical injection arranged at a chemical substance injection point in the extraction network 10. For example, the plurality of inhibition apparatuses 270*a* to 270*f* according to the present embodiment are provided corresponding to the plurality of wellheads 100*a* to 100*f*, and each inhibition apparatus 270 injects MEG into the natural resource from the corresponding wellhead 100.

An inhibition apparatus 270 serving as a heater apparatus is installed at a specified location in a flow path of the extraction network 10 and heats the pipe at this location, in order to inhibit at least one of the hydration of the natural resource, precipitation of wax, and precipitation of asphaltenes. Such an inhibition apparatus 270 receives a power source supply from the platform 170 to perform at least one of turning heating ON/OFF and adjusting the heating amount, according to instructions from the platform 170.

An inhibition apparatus 270 serving as a valve apparatus adjusts the flow rate of the natural resource in a flow path of the extraction network 10 in order to inhibit at least on of hydration and precipitation of asphaltenes. Such an inhibition apparatus 270 can inhibit the hydration and precipitation of asphaltenes by reducing the pressure of the natural resource upstream from the inhibition apparatus 270 to a target value, by reducing the flow rate of the natural resource flowing from the wellhead 100 side, for example. Furthermore, this inhibition apparatus 270 can adjust the pressure of the natural resource in each inflow path upstream from the inhibition apparatus 270 and the pressure of the natural resource in the outflow path after the merging to be target values, by adjusting the flow rate of the natural resource merging from each inflow path in the manifolds 120 or the like. Such an inhibition apparatus 270 receives a power source supply from the platform 170 to perform at least one of adjustment of the opening degree of a flow rate control valve and opening/closing of an opening/closing valve, according to instructions from the platform 170.

The terminal apparatus 280 is connected to the apparatus 200 wirelessly or in a wired manner, provides the user with information output by the apparatus 200, has user instructions input thereto, and transmits the user instructions to the apparatus 200. The terminal apparatus 280 may be a computer such as a PC (Personal Computer), tablet computer, smart phone, or work station, a specialized terminal for this use, or a user interface apparatus such as a display apparatus an input apparatus connected to the apparatus 200.

According to the apparatus 200 described above, it is possible to estimate the state of the natural resource at locations of interest in the extraction network 10 or throughout the entire extraction network 10, using the measurement data acquired by installing the measurement devices 180 in parts of the extremely long extraction network 10. Therefore, even if a large number of measurement devices 180 are not installed over the entire extraction network 10, the apparatus 200 can estimate the dynamic state of the natural resource in the extraction network 10 and provide this information to the user.

According to the apparatus 200 described above, by providing the margin calculating section 240, it is possible to calculate the margin until flow path blocking matter is generated in the extraction network 10, based on the estimation results of the state of the natural resource, and also to quantitatively indicate whether the suppression for inhibiting the generation of the flow path blocking matter is being performed to an appropriate degree.

According to the apparatus 200 described above, by providing the determining section 250, it is possible to determine the recommended operational amount of each inhibition apparatus 270 based on the margin, and to show how to control each inhibition apparatus 270 according to the dynamic state of the natural resource.

According to the apparatus 200 described above, by providing the control section 260, it is possible to automatically control each inhibition apparatus 270 according to the recommended operational amount determined by the determining section 250, and to perform the process for inhibiting the generation of the flow path blocking matter to an appropriate degree without relying on the experience or intuition of the user.

The apparatus 200 may adopt a configuration that omits at least one of the margin calculating section 240, the determining section 250, and the control section 260, in which case the user may perform at least one of the margin judgment, the determination of the operational amounts of the inhibition apparatuses 270, and the control of the inhibition apparatuses 270.

Figure 3:
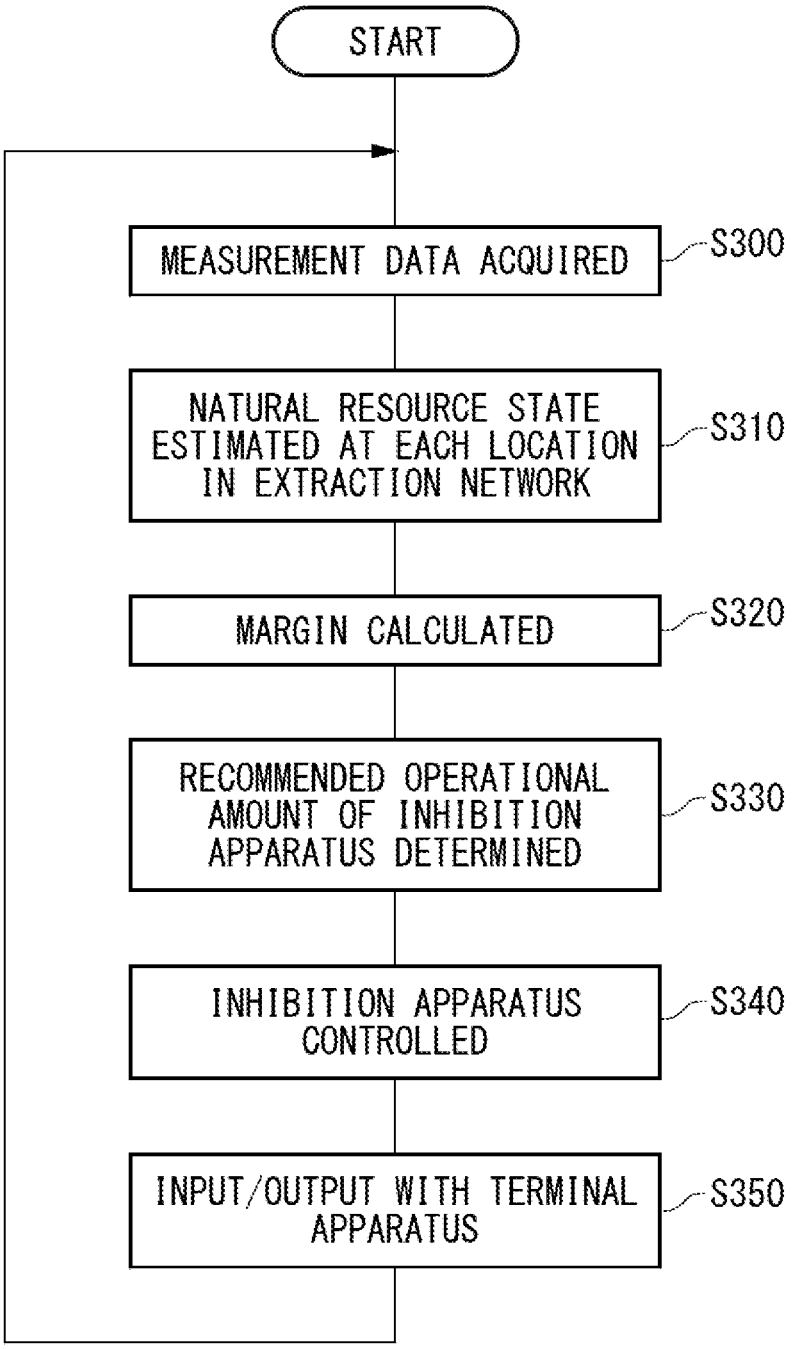
FIG. 3 shows an operational flow of the apparatus 200 according to the present embodiment.

FIG. 3 shows an operational flow of the apparatus 200 according to the present embodiment. At step S300, the data acquiring section 210 acquires the measurement data measured by each of the one or more measurement devices 180. In the present embodiment, the measurement devices 180 are provided respectively to the wellheads 100*a* to 100*f*, for example, and each measurement device 180 outputs measurement data indicating the state of the natural resource flowing into the extraction network 10 from the well side. Instead of or in addition to this, at least one measurement device 180 may be provided on the outlet side of the extraction network 10 in the platform 170, and this measurement device 180 may output measurement data indicating the state of at least one natural resource flowing out from the extraction network 10. Furthermore, at least one measurement device 180 may be provided within a flow path in the extraction network 10, and this measurement device 180 may output measurement data indicating the state of the natural resource flowing through this location.

At S310, the state estimating section 230 estimates the state of the natural resource at one or more locations in the flow paths of the extraction network 10, using the measurement data of each measurement device 180 and the model of the extraction network 10 stored in the model storage section 220. The detailed process of the state estimating section 230 performed at S310 is described further below in relation to FIG. 4.

At S320, the margin calculating section 240 calculates the margin until flow path blocking matter is generated in the extraction network 10, based on the state of the natural resource estimated by the state estimating section 230. The detailed process of the margin calculating section 240 performed at S320 is described further below in relation to FIG. 5.

At S330, the determining section 250 determines the recommended operational amount of each inhibition apparatus 270 for inhibiting the generation of the flow path blocking matter, based on the margin calculated by the margin calculating section 240. For example, the determining section 250 adjusts the recommended operational amount such that the margin calculated by the margin calculating section 240 approaches a preset target margin or becomes within a preset target margin range. As an example, the determining section 250 may set the recommended operational amount to be a smaller operational amount than the current operational amount of the inhibition apparatus 270 if the margin is greater than the target margin or the upper limit of the target margin range, and may set the recommended operational amount to be a greater operational amount than the current operational amount of the inhibition apparatus 270 if the margin is less than the target margin or the lower limit of the target margin range. At this time, the determining section 250 may determine a recommended operational amount that differs more greatly from the current operational amount when the absolute value of the difference between the margin and the target margin or the like is larger. Since there could be a relatively long delay time from when the operational amount of an inhibition apparatus 270 is changed to when the margin calculated by the margin calculating section 240 changes, the determining section 250 may perform a process such as providing a limit for the change speed of the recommended operational amount in order to prevent an overshoot of the operational amount of the inhibition apparatus 270.

At S340, the control section 260 performs control causing each inhibition apparatus 270 to operate according to the recommended operational amount determined by the determining section 250. In response to receiving instructions that a certain inhibition apparatus 270 operates with an operational amount differing from the recommended operational amount from the terminal apparatus 280 via the terminal interface 265, the control section 260 may perform control to cause this inhibition apparatus 270 to operate with the designated operational amount.

At S350, the terminal interface 265 performs input/output with the terminal apparatus 280. As an example, the terminal interface 265 outputs to the terminal apparatus 280 at least one of the measurement data acquired by the data acquiring section 210, the state of the natural resource in the extraction network 10 estimated by the state estimating section 230, the margin calculated by the margin calculating section 240, the recommended operational amount of each inhibition apparatus 270 determined by the determining section 250, and the control state of each inhibition apparatus 270 caused by the control section 260, to be displayed by the terminal apparatus 280. Furthermore, in response to receiving user instructions from the terminal apparatus 280, the terminal interface 265 provides these instructions to the control section 260. The control section 260 that has received these instructions may control each inhibition apparatus 270 according to these instructions, in the next instance of the process of S340. The terminal interface 265 may perform the input/output process shown in S350 at any of one or more timings between S300 and S340 of FIG. 3, or may perform the input/output process in parallel with S300 to S340.

The apparatus 200 can adjust the operational amount of each inhibition apparatus 270 according to the change in the state of the natural resource during extraction, by repeating the processes from S300 to S350 described above. In this way, the apparatus 200 can prevent each inhibition apparatus 270 from operating with a needlessly high operational amount, while still inhibiting the generation of flow path blocking matter, and therefore both the environmental impact and the cost can be reduced.

In the above description, the apparatus 200 sets the operational amounts of the inhibition apparatuses 270 automatically according to the determined recommended operational amounts, but instead, the apparatus 200 may output the determined recommended operational amounts to the terminal apparatus 280, and set the operational amounts of the inhibition apparatuses 270 after receiving confirmation from a user of the extraction network 10. Furthermore, the apparatus 200 may output the determined recommended operational amounts to the terminal apparatus 280, and leave the setting of the operational amounts of the inhibition apparatuses 270 up to the user.

Furthermore, the apparatus 200 may omit the margin calculating section 240, the determining section 250, and the control section 260 and only perform output up to the estimated state of the natural resource, or may omit the determining section 250 and the control section 260 and only perform output up to the margin.

Figure 4:
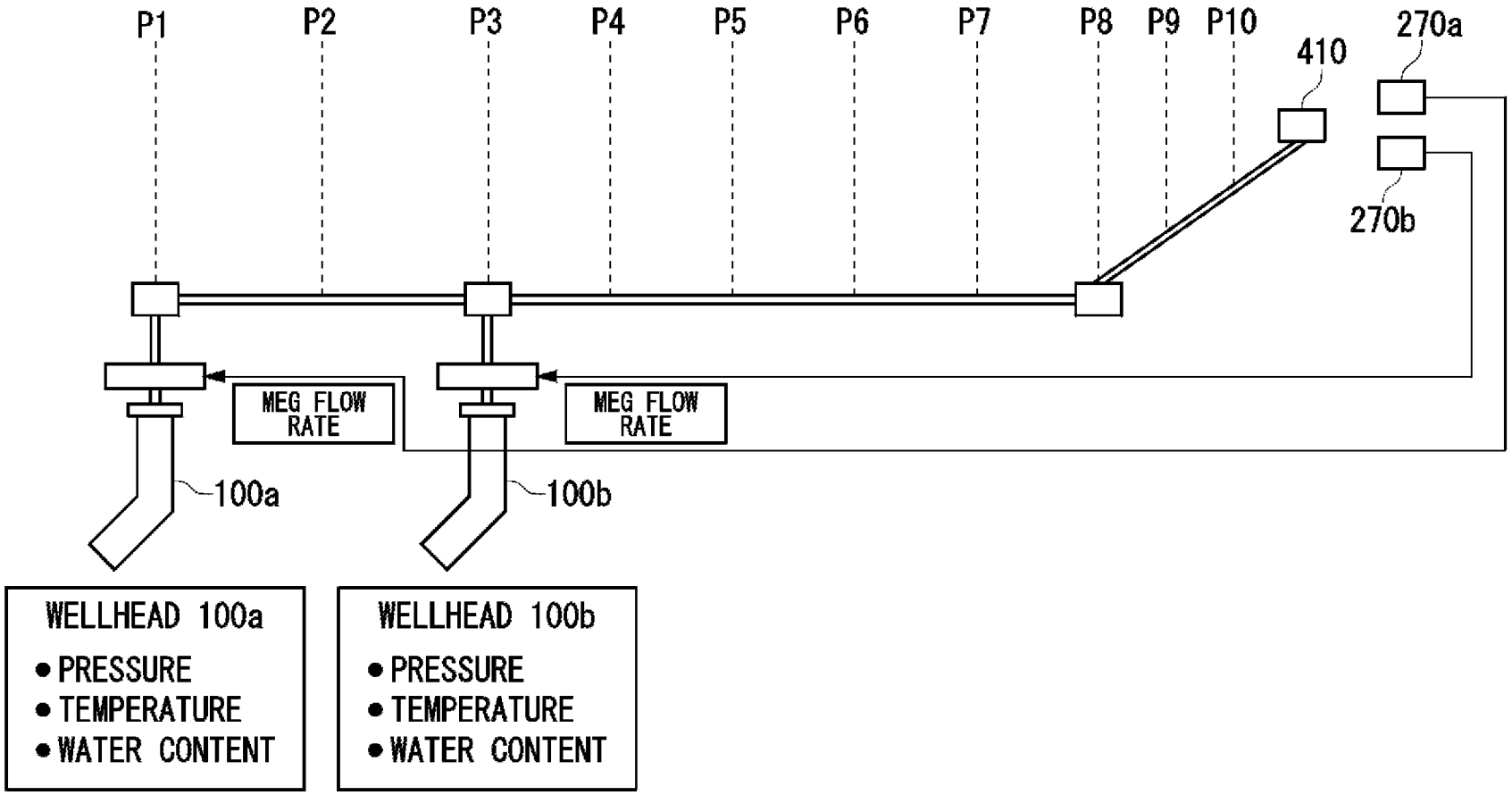
FIG. 4 shows an example of a model 400 of the extraction network that is a processing target in the present embodiment.

FIG. 4 shows an example of a model 400 of the extraction network that is a processing target in the present embodiment. In the model 400 of the present drawing, an extraction network that is simpler than the extraction network 10 shown in FIG. 1 is shown as an example, for convenience of the description. However, the apparatus 200 can be applied to various extraction networks, including the extraction network 10 shown in FIG. 1.

The extraction network that is the target of the model 400 of the present drawing includes wellheads 100*a* and 100*b*, and the natural resource extracted from each of the wellheads 100 and 100*b* is transported to the outlet 410. The wellhead 100*a* and the wellhead 100*b* include one or more measurement devices 180 that measure the pressure, temperature, and water content of the natural resource flowing therethrough.

Inhibition apparatuses 270*a* and 270*b*, which are MEG injection apparatuses, are provided on the outlet 410 side of the extraction network. The inhibition apparatus 270*a* supplies MEG to the wellhead 100*a* and the inhibition apparatus 270*b* supplies MEG to the wellhead 100*b*, and the MEG is injected into the natural resource from each wellhead 100.

Furthermore, the model 400 may include at least one parameter, such as a characteristic of the flow path and an environmental condition, used for predicting at least one of the pressure, volume, temperature, and the like of the natural resource in the extraction network.

At S310 in FIG. 3, the state estimating section 230 estimates the state of the natural resource at each of a plurality of locations in the flow paths of the extraction network, using the model 400, the measurement data of each measurement device 180, and, if necessary, the operational amount of each inhibition apparatus 270. The state estimating section 230 may estimate the state of the natural resource for each of the plurality of segments obtained by segmenting the extraction network. In the example of the present drawing, the state estimating section 230 estimates the state of the natural resource at each of the locations indicated by P1 to P10 in the drawing.

The state estimating section 230 estimates the state of the natural resource at each location in the extraction network by analyzing the pressure, volume, or temperature, for example. As an example, the state estimating section 230 performs a simulation by applying a fluid analysis of at least one of the pressure, temperature, flow rate, and component ratio of a fluid (natural resource) included in each segment obtained by segmenting the flow path of the extraction network.

In the simulation, the state estimating section 230 may segment the flow path of the extraction network into tiny segments and use the model 400 having a network structure in which each tiny segment, other than the tiny segments corresponding to the end portions of the extraction network, is adjacent to a tiny segment on the upstream side thereof and a tiny segment on the downstream side thereof, for example. In this case, the tiny segments corresponding to merge points in the flow paths are each adjacent to a plurality of tiny segments on the upstream side thereof. Here, the length of each tiny segment may be suitably set by the user or the like according to the necessary calculation precision and the computing power of the apparatus 200.

For each tiny segment, the state estimating section 230 calculates each state parameter, such as the at least one of the pressure, flow rate, temperature, and component ratio, in the target tiny segment for each unit of time, using a differential equation that uses each state parameter of the adjacent tiny segments and each parameter of the target tiny segment.

As an example, the state estimating section 230 may calculate the pressure and flow rate of a target tiny segment according to the pressures and flow rates of the tiny segments on the upstream side and the downstream side thereof. Furthermore, the state estimating section 230 may calculate the inflow rate of fluid from the upstream side to the target tiny segment based on the flow rate in the tiny segment on the upstream side, and calculate the outflow rate of the fluid from the target tiny segment to the downstream side based on the flow rate in the target tiny segment.

The state estimating section 230 may then calculate the temperature of the fluid of the target tiny segment at the next timing, based on the inflow rate and temperature of the fluid from the upstream side, the outflow rate of fluid flowing to the downstream side, and the amount and temperature of the fluid remaining in the target tiny segment. Here, the state estimating section 230 may calculate the amount of heat lost from the target tiny segment using the thermal conductivity of the pipe and temperature outside the pipe in the target tiny segment, and reflect this heat loss in the temperature of the fluid in the target tiny segment.

Furthermore, using the water content of the fluid and the component ratio such as the MEG ratio, the state estimating section 230 may calculate the inflow rate of the fluid from the upstream side and the outflow rate of the fluid to the downstream side in the target tiny segment, for each component of the fluid, and calculate the component ratio of the fluid in the target tiny segment.

In the calculation described above, for a tiny segment in which a measurement device 180 is installed, the state estimating section 230 may set the state parameter for which the measurement data acquired from the measurement device 180 is obtained, from among the state parameters of this tiny segment, to be a value corresponding to the measurement data.

Furthermore, instead of modelling the pipeline as a one-dimensional flow path as described above, the pipeline may be modeled as a three-dimensional stereoscopic structure, and the state estimating section 230 may segment this pipeline into a plurality of elements and calculate the state parameter of the fluid in each element using a finite difference method, finite element method, or the like, based on the state parameters of adjacent elements.

Figure 5:
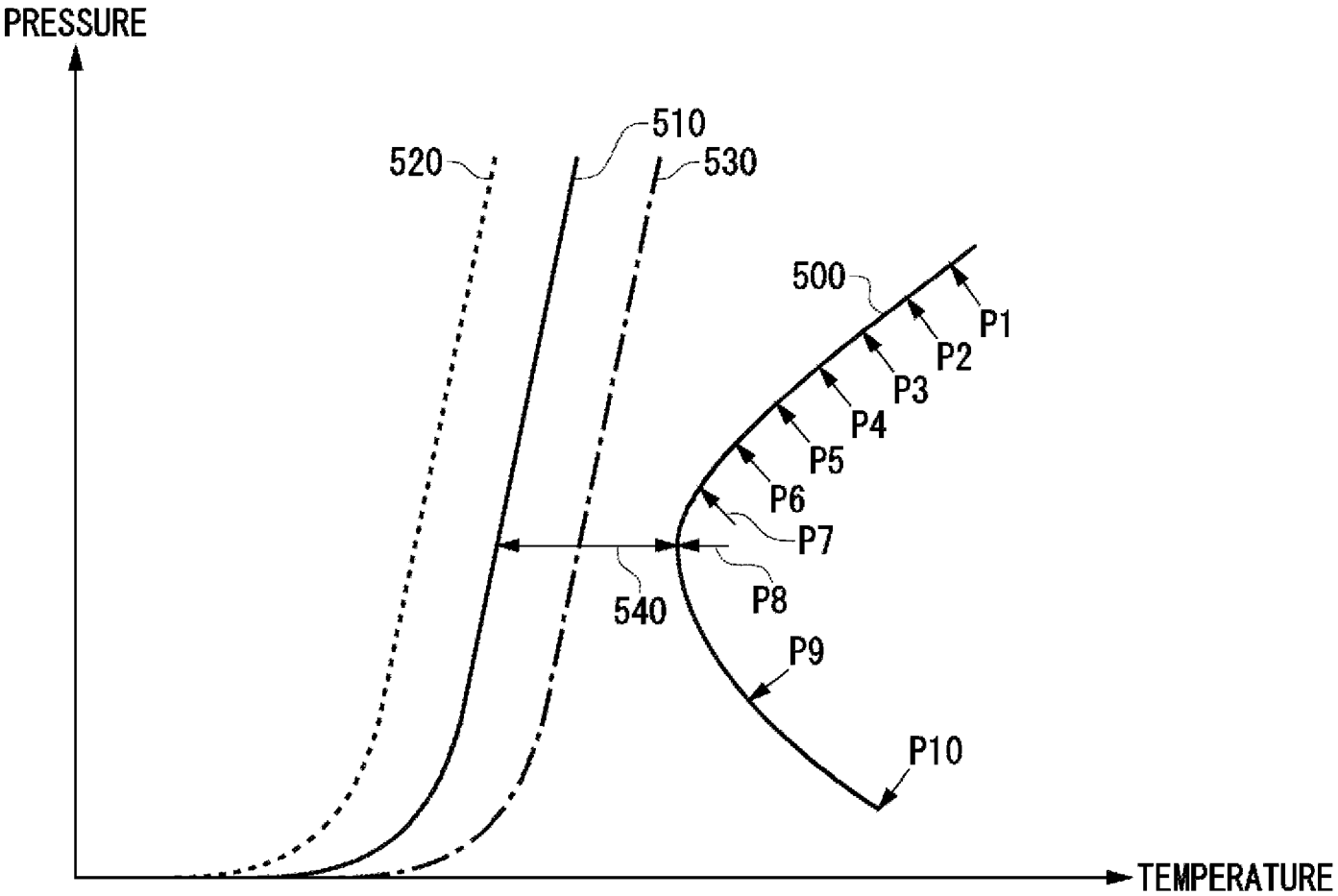
FIG. 5 shows a state of the natural resource in the extraction network estimated by the apparatus 200 according to the present embodiment.

FIG. 5 shows a state of the natural resource in the extraction network estimated by the apparatus 200 according to the present embodiment. In the graph of FIG. 5, the horizontal axis indicates the temperature, the vertical axis indicates the pressure, and a state curve 500 and a critical curve 510 are shown. The state curve 500 indicates the results obtained by the state estimating section 230 estimating the pressure and temperature of the natural resource at each of the plurality of locations P1 to P10 in FIG. 4. As shown in the present drawing, the natural resource flows into the extraction network (P1 in the drawing) in a high-temperature and high-pressure state at the well side, and the temperature and pressure of the natural resource both gradually drop as the natural resource flows through the extraction network on the ocean floor (P2 to P8). After this, the natural resource is guided to the platform on the ocean surface by the riser, and the pressure decreases while the temperature of the increases, as the depth decreases (P9 to P10).

At S320 in FIG. 3, the margin calculating section 240 calculates the state of the natural resource that is the critical point at which flow path blocking matter is generated. In the present drawing, the margin calculating section 240 calculates the critical curve 510 indicating the relationship between the pressure and temperature causing the critical point at which the flow path blocking matter is generated. In the present drawing, the critical curve 510 indicates the relationship between the pressure and temperature causing the critical point at which the natural resource becomes hydrated. The natural resource is hydrated at points on and to the left of the critical curve 510. In the example of the present drawing, a model is used in which the component ratio of the natural resource in the extraction network is treated as being constant. The margin calculating section 240 may calculate the critical curve 510 corresponding to the component ratio of the natural resource in the extraction network.

At S320 in FIG. 3, the margin calculating section 240 calculates the margin using the pressures and temperatures at a plurality of locations and the pressure and temperature causing the critical point at which the flow path blocking matter is generated. As an example, the margin calculating section 240 calculates the temperature difference at the location where the temperature difference between the state curve 500 and the critical curve 510 at the same pressure is at a minimum, as the temperature margin 540. Instead, the margin calculating section 240 may output the margin to the user, by outputting a graph such as the pressure and temperature graph including the state curve 500 and the critical curve 510 to the terminal apparatus 280 via the terminal interface 265.

At S330 in FIG. 3, the determining section 250 determines the recommended operational amount of each inhibition apparatus 270 for inhibiting generation of the flow path blocking matter, based on the margin calculated by the margin calculating section 240. As an example, if the temperature margin 540 is larger than the target margin, the determining section 250 may determine a recommended operational amount that decreases the amount of MEG injected by the inhibition apparatus 270, to cause the critical curve 510 to approach the critical curve 530 that is closer to the state curve 500. Furthermore, if the temperature margin 540 is smaller than the target margin, the determining section 250 may determine a recommended operational amount that increases the amount of MEG injected by the inhibition apparatus 270, to cause the critical curve 510 to approach the critical curve 520 that is farther from the state curve 500.

Here, since the natural resource flows from the well side to the platform side, the determining section 250 may change the margin at the location in the extraction network where the margin is at a minimum by changing the operational rate of an inhibition apparatus 270 that can change the state of the natural resource at this location or upstream from this location. For example, if P2 in FIG. 4 is the location where the margin is at a minimum, the determining section 250 may change the margin of the entire extraction network by changing the operational amount of the inhibition apparatus 270*a* that injects MEG into the wellhead 100*a*.

In the extraction network 10 where many flow paths merge, such as shown in FIG. 1, when the operational amount of the inhibition apparatus 270 that injects MEG into the wellhead 100*a* is increased in order to increase the margin of the jumper 110*a*, for example, the margin of the flowline 150*b* also becomes higher than the target margin. In this case, the determining section 250 may adjust the balance of the margin of the entire extraction network 10 by decreasing the amount of MEG injected into the wellhead 100*b* or the wellhead 100*d*, for example. In order to realize this, the determining section 250 may select a more favorable set of recommended operational amounts, based on a result of simulating the movement of the future margin when each inhibition apparatus 270 is made to operate, from among a plurality of candidates including sets of the recommended operational amounts of each inhibition apparatus 270 at the current timing. The determining section 250 may select a set having a predefined evaluation indicator (e.g. a KPI: Key Performance Indicator) that indicates the best evaluation, using at least one of the cost, environmental impact, and the like corresponding to the operational amount of each inhibition apparatus 270, as the more favorable set of recommended operational amounts.

According to the apparatus 200 described above, it is possible to estimate the state of the natural resource in each segment obtained by segmenting the extraction network into many segments or at a plurality of locations in the flow paths of the extraction network. The apparatus 200 can then calculate the margin for the entire extraction network, such that the flow path blocking matter is not generated even at the location having the smallest margin, among the plurality of locations or the like. In this way, the apparatus 200 can clearly indicate the risk of the extraction network becoming blocked due to flow path blocking matter, using a small number of parameters.

Furthermore, according to the apparatus 200, it is possible to determine the recommended operational amount of each inhibition apparatus 270 and to control each inhibition apparatus 270 such that the calculated margin approaches the target margin. Accordingly, with the apparatus 200 it is possible to reduce the number of work steps performed by a manager, engineer, worker, or the like involved with the extraction network, and to control each inhibition apparatus 270 based on objective indicators without relying on experience or intuition.

In the above description, the apparatus 200 calculates one margin for the entire extraction network that is the target of the model 400, as a representative value, but instead, the apparatus 200 may calculate an individual margin for each of a plurality of segments (e.g. segments without branching or merging points, or a range that is a subtree portion of an extraction network) in the extraction network 10 or in an extraction network that is even more complicated.

Furthermore, the state estimating section 230 may calculate the component ratio of the natural resource as a value that can be different at each of a plurality of locations in the flow paths of the extraction network. For example, if there is a rising slope in the flow path of the extraction network, it is possible that the flow rate of a component with low specific gravity would be greater than the flow rate of a component with high specific gravity. Furthermore, if there is a vaporized component in the flow path of the extraction network, it is possible that the flow rate of the vaporized component would be greater than the flow rate of a liquid component. Therefore, the state estimating section 230 can calculate the component ratio of the natural resource at each of a plurality of locations by performing a simulation or the like for the flow rate of each component in each tiny segment.

In this case, at each of the plurality of locations in the flow path of the extraction network, the margin calculating section 240 calculates the state of the natural resource causing the critical point at which flow path blocking matter is generated at this location, using the component ratio of the natural resource at this location. As an example, the margin calculating section 240 may calculate the critical curve 510 at each location. Then, for each location, the margin calculating section 240 calculates the margin using the pressure and temperature of the natural resource at this location and the critical curve 510 at this location. For example, the margin calculating section 240 calculates, as the temperature margin, the temperature difference between the natural resource at this location and the temperature corresponding to the pressure of the natural resource at this location on the critical curve 510.

Figure 6:
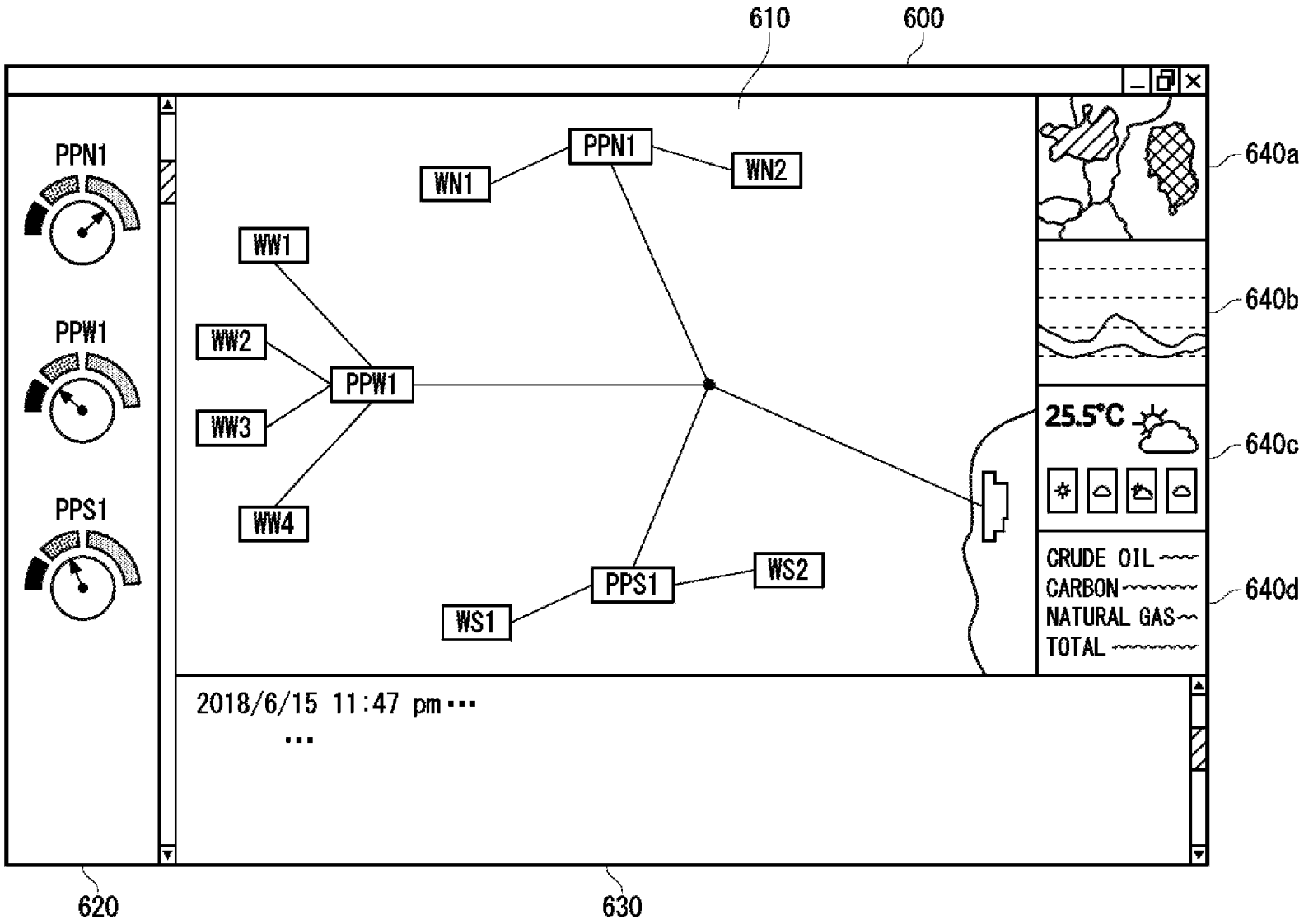
FIG. 6 shows a first example of a dashboard 600 output by the apparatus 200 according to the present embodiment.

FIG. 6 shows a first example of a dashboard 600 output by the apparatus 200 according to the present embodiment. At S350 in FIG. 3, the terminal interface 265 may output to the terminal apparatus 280 screen data for displaying the screen shown in the present drawing in the terminal apparatus 280.

The dashboard 600 includes an overview display 610, a margin display 620, a message display 630, and one or more widget display 640*a* to 640*d* (also referred to as the "widget displays 640"). The overview display 610 shows the overall structure of the extraction network that is the target of the apparatus 200. The overview display 610 may display the name or abbreviation of each structure forming the extraction network, on a map or an aerial photograph. In the present drawing, WS, WN, and WW are abbreviations for Well South, Well North, and Well West, and PPS, PPN, and PPW are abbreviations for Production Platform South, Production Platform North, and Production Platform West. The extraction network shown in the present drawing transports the natural resource extracted from the wells in the respective directions to the production platforms, and performs production processing such as processing, separation, and the like of the natural resource. This extraction network sends the resources that have been processed by the production platforms in the respective directions to an onshore plant to the East, via a pipeline.

The margin display 620 performs control to display the margin until the generation of flow path blocking matter, at each location in the extraction network, in the terminal apparatus 280. In the present drawing, the margin display 620 displays in the overview display 610 each of the margin ("PPN1" in the drawing) for the flow paths from the north wells WN1 to WN2 to the north production platform PPN1, the margin ("PPW1" in the drawing) for the flow paths from the west wells WW1 to WW4 to the west production platform PPW1, and the margin ("PPS1" in the drawing) for the flow paths from the south wells WS1 to WS2 to the south production platform PPS1. In other words, in the present example, the margin indicated by PPN1 is a value (representative value) obtained as the total of the margins of all of the flow paths present in the north well WN1 connected to the north production platform PPN1, and this margin functions as a representative KPI indicating whether the state of the north production platform PPN1 is good or bad. Furthermore, the margin indicated by PPS1 and the margin indicated by PPW1 are similar. If even more margins are to be indicated, the terminal interface 265 may perform control to display the margins at other locations by scrolling the margin display 620, for example, in response to receiving instructions for scrolling or the like of the display of the margin display 620 from the terminal apparatus 280.

The message display 630 displays various messages from the apparatus 200 to the user. The terminal interface 265 may perform control to display a message providing notification of an event in the message display 630, in response to the occurrence of a predetermined event such as the margin of the entire extraction network or at a certain location becoming less than the lower limit of the target margin range, this margin exceeding the upper limit of the target margin range, an inhibition apparatus 270 being turned ON or OFF, the state of the natural resource measured by a measurement device 180 being outside a preset range, or another event, for example.

Each of the one or more widget displays 640 displays various pieces of related information relating to the extraction of the natural resource, such as a map of weather around the extraction network (widget display 640*a*), temperature change (widget display 640*b*), weather and weather forecasts (widget display 640*c*), and amount of resources extracted from the oil field or gas field (widget display 640*d*), for example. The terminal interface 265 may be capable of customizing information displayed by each widget display 640, in response to instructions from the user using the terminal apparatus 280.

Figure 7:
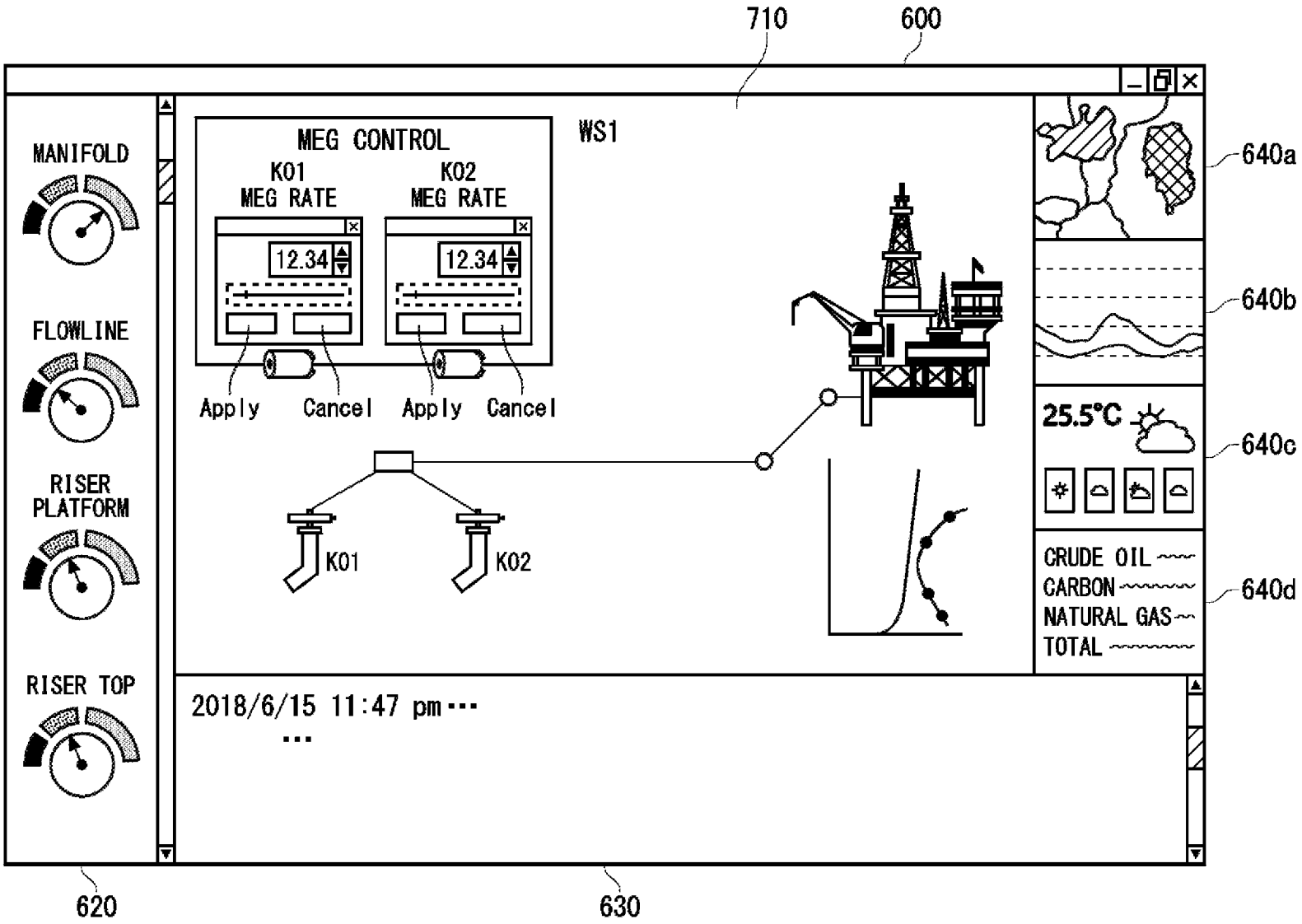
FIG. 7 shows a second example of a dashboard 600 output by the apparatus 200 according to the present embodiment.

FIG. 7 shows a second example of a dashboard 600 output by the apparatus 200 according to the present embodiment. In response to the user of the terminal apparatus 280 selecting a portion of the extraction network such as the south well WS1, for example, the terminal interface 265 may perform control to display information concerning the selected portion in the display screen of the dashboard 600 shown in FIG. 6.

A basic well display 710 is a screen showing basic information of the selected portion (e.g. the south well WS1), displayed in response to this portion of the extraction network, i.e. the south well WS1, being selected in the overview display 610. The terminal interface 265 may perform control to display, as the basic information, at least one of a connection relationship in the selected portion of the extraction network, the margin and state of the natural resource in each segment of the flow path included in the selected portion (e.g. the manifold, flowline, riser platform, and riser top into which the natural resource flows from the wellheads KO1 and KO2 provided in the south well WS1 in the drawing), the operational amount of each inhibition apparatus 270, and the like. Furthermore, the terminal interface 265 may perform control to display an input box or the like enabling the manual setting of the operational amount of each inhibition apparatus 270, to be displayed in the upper left portion in the basic well display 710.

Various embodiments of the present invention may be described with reference to flowcharts and block diagrams whose blocks may represent (1) steps of processes in which operations are performed or (2) sections of apparatuses responsible for performing operations. Certain steps and sections may be implemented by dedicated circuitry, programmable circuitry supplied with computer-readable instructions stored on computer-readable media, and/or processors supplied with computer-readable instructions stored on computer-readable media. Dedicated circuitry may include digital and/or analog hardware circuits and may include integrated circuits (IC) and/or discrete circuits. Programmable circuitry may include reconfigurable hardware circuits comprising logical AND, OR, XOR, NAND, NOR, and other logical operations, flip-flops, registers, memory elements, etc., such as field-programmable gate arrays (FPGA), programmable logic arrays (PLA), etc.

Computer-readable media may include any tangible device that can store instructions for execution by a suitable device, such that the computer-readable medium having instructions stored therein comprises an article of manufacture including instructions which can be executed to create means for performing operations specified in the flowcharts or block diagrams. Examples of computer-readable media may include an electronic storage medium, a magnetic storage medium, an optical storage medium, an electromagnetic storage medium, a semiconductor storage medium, etc. More specific examples of computer-readable media may include a floppy disk, a diskette, a hard disk, a random access memory (RAM), a read-only memory (ROM), an erasable programmable read-only memory (EPROM or Flash memory), an electrically erasable programmable read-only memory (EEPROM), a static random access memory (SRAM), a compact disc read-only memory (CD-ROM), a digital versatile disk (DVD), a BLU-RAY® disc, a memory stick, an integrated circuit card, etc.

Computer-readable instructions may include assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, JAVA®, C++, etc., and conventional procedural programming languages, such as the "C" programming language or similar programming languages.

Computer-readable instructions may be provided to a processor of a general purpose computer, special purpose computer, or other programmable data processing apparatus, or to programmable circuitry, locally or via a local area network (LAN), wide area network (WAN) such as the Internet, etc., to execute the computer-readable instructions to create means for performing operations specified in the flowcharts or block diagrams. Examples of processors include computer processors, processing units, microprocessors, digital signal processors, controllers, microcontrollers, etc.

Figure 8:
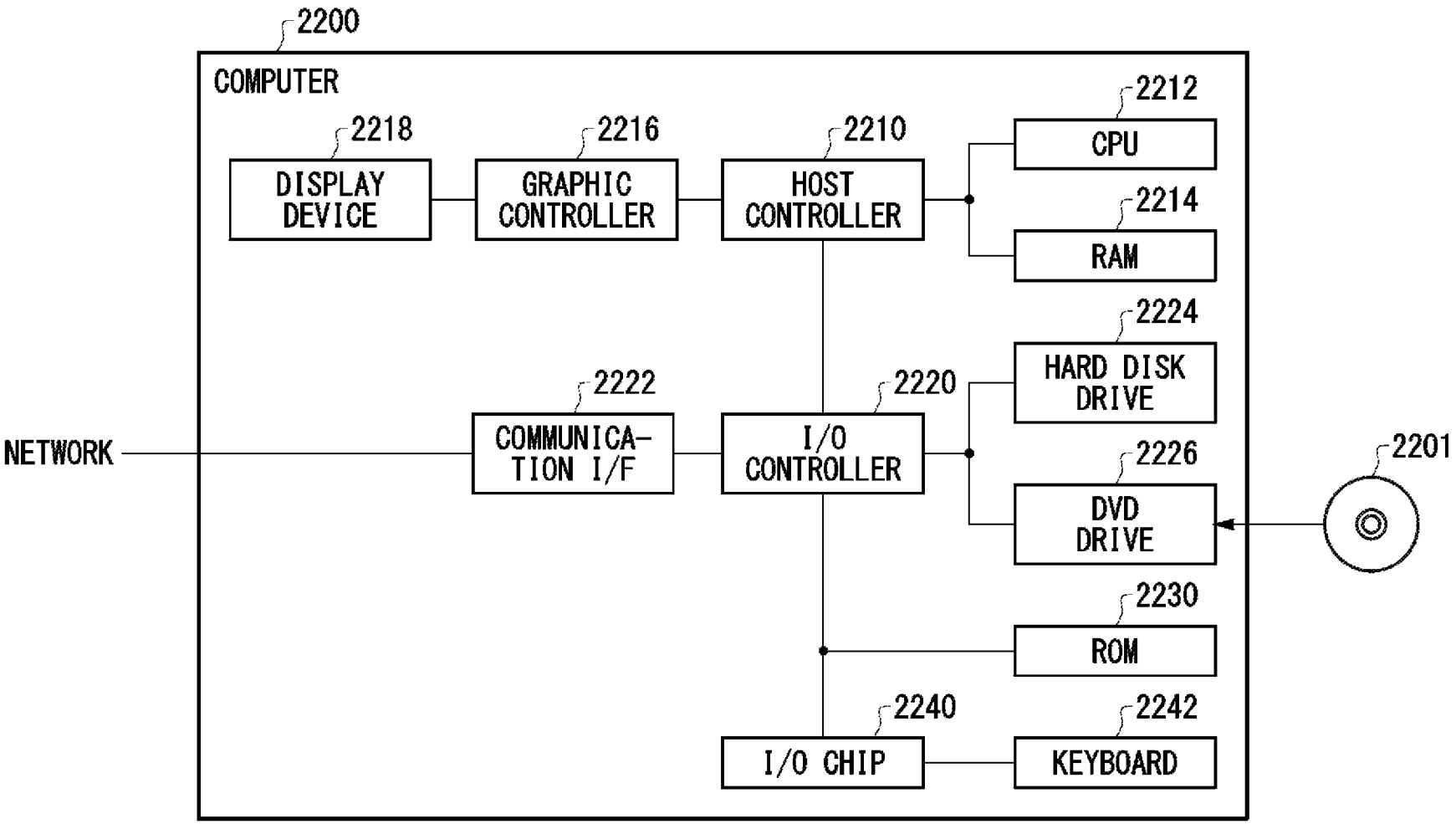
FIG. 8 shows an example of a computer 2200 in which aspects of the present invention may be wholly or partly embodied.

FIG. 8 shows an example of a computer 2200 in which aspects of the present invention may be wholly or partly embodied. A program that is installed in the computer 2200 can cause the computer 2200 to function as or perform operations associated with apparatuses of the embodiments of the present invention or one or more sections thereof, and/or cause the computer 2200 to perform processes of the embodiments of the present invention or steps thereof. Such a program may be executed by the CPU 2212 to cause the computer 2200 to perform certain operations associated with some or all of the blocks of flowcharts and block diagrams described herein.

The computer 2200 according to the present embodiment includes a CPU 2212, a RAM 2214, a graphic controller 2216, and a display device 2218, which are mutually connected by a host controller 2210. The computer 2200 also includes input/output units such as a communication interface 2222, a hard disk drive 2224, a DVD-ROM drive 2226 and an IC card drive, which are connected to the host controller 2210 via an input/output controller 2220. The computer also includes legacy input/output units such as a ROM 2230 and a keyboard 2242, which are connected to the input/output controller 2220 through an input/output chip 2240.

The CPU 2212 operates according to programs stored in the ROM 2230 and the RAM 2214, thereby controlling each unit. The graphic controller 2216 obtains image data generated by the CPU 2212 on a frame buffer or the like provided in the RAM 2214 or in itself, and causes the image data to be displayed on the display device 2218.

The communication interface 2222 communicates with other electronic devices via a network. The hard disk drive 2224 stores programs and data used by the CPU 2212 within the computer 2200. The DVD-ROM drive 2226 reads the programs or the data from the DVD-ROM 2201, and provides the hard disk drive 2224 with the programs or the data via the RAM 2214. The IC card drive reads programs and data from an IC card, and/or writes programs and data into the IC card.

The ROM 2230 stores therein a boot program or the like executed by the computer 2200 at the time of activation, and/or a program depending on the hardware of the computer 2200. The input/output chip 2240 may also connect various input/output units via a parallel port, a serial port, a keyboard port, a mouse port, and the like to the input/output controller 2220.

A program is provided by computer readable media such as the DVD-ROM 2201 or the IC card. The program is read from the computer readable media, installed into the hard disk drive 2224, RAM 2214, or ROM 2230, which are also examples of computer readable media, and executed by the CPU 2212. The information processing described in these programs is read into the computer 2200, resulting in cooperation between a program and the above-mentioned various types of hardware resources. An apparatus or method may be constituted by realizing the operation or processing of information in accordance with the usage of the computer 2200.

For example, when communication is performed between the computer 2200 and an external device, the CPU 2212 may execute a communication program loaded onto the RAM 2214 to instruct communication processing to the communication interface 2222, based on the processing described in the communication program. The communication interface 2222, under control of the CPU 2212, reads transmission data stored on a transmission buffering region provided in a recording medium such as the RAM 2214, the hard disk drive 2224, the DVD-ROM 2201, or the IC card, and transmits the read transmission data to a network or writes reception data received from a network to a reception buffering region or the like provided on the recording medium.

In addition, the CPU 2212 may cause all or a necessary portion of a file or a database to be read into the RAM 2214, the file or the database having been stored in an external recording medium such as the hard disk drive 2224, the DVD-ROM drive 2226 (DVD-ROM 2201), the IC card, etc., and perform various types of processing on the data on the RAM 2214. The CPU 2212 may then write back the processed data to the external recording medium.

Various types of information, such as various types of programs, data, tables, and databases, may be stored in the recording medium to undergo information processing. The CPU 2212 may perform various types of processing on the data read from the RAM 2214, which includes various types of operations, processing of information, condition judging, conditional branch, unconditional branch, search/replace of information, etc., as described throughout this disclosure and designated by an instruction sequence of programs, and writes the result back to the RAM 2214. In addition, the CPU 2212 may search for information in a file, a database, etc., in the recording medium. For example, when a plurality of entries, each having an attribute value of a first attribute associated with an attribute value of a second attribute, are stored in the recording medium, the CPU 2212 may search for an entry matching the condition whose attribute value of the first attribute is designated, from among the plurality of entries, and read the attribute value of the second attribute stored in the entry, thereby obtaining the attribute value of the second attribute associated with the first attribute satisfying the predetermined condition.

The above-explained program or software modules may be stored in the computer readable media on or near the computer 2200. In addition, a recording medium such as a hard disk or a RAM provided in a server system connected to a dedicated communication network or the Internet can be used as the computer readable media, thereby providing the program to the computer 2200 via the network.

While the embodiment(s) of the present invention has (have) been described, the technical scope of the invention is not limited to the above described embodiment(s). It is apparent to persons skilled in the art that various alterations and improvements can be added to the above-described embodiment(s). It is also apparent from the scope of the claims that the embodiments added with such alterations or improvements can be included in the technical scope of the invention.

For example, the apparatus 200 may estimate the natural resource using environment information such as the air temperature or water temperature around the extraction network, in addition to the measurement data from each measurement device 180.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

REFERENCE SIGNS LIST

10: extraction network, 100*a*-100*f*: wellhead, 110*a*-110*f*: jumper, 120*a*-120*c*: manifold, 125*a*-125*d*: jumper, 140*a*-140*d*: PLEM, 150: flowline, 160: riser, 170: platform, 180*a*-180*f*: measurement device, 200: apparatus, 210: data acquiring section, 220: model storage section, 230: state estimating section, 240: margin calculating section, 250: determining section, 260: control section, 265: terminal interface, 270*a*-270*g*: inhibition apparatus, 280: terminal apparatus, 400: model, 410: outlet, 500: state curve, 510: critical curve, 520: critical curve, 530: critical curve, 540: temperature margin, 600: dashboard, 610: overview display, 620: margin display, 630: message display, 640*a*-640*d*: widget display, 710: basic well display, 2200: computer, 2201: DVD-ROM, 2210: host controller, 2212: CPU, 2214: RAM, 2216: graphic controller, 2218: display device, 2220: input/output controller, 2222: communication interface, 2224: hard disk drive, 2226: DVD-ROM drive, 2230: ROM, 2240: input/output chip, 2242: keyboard

What is claimed is:

1. An apparatus comprising:

a data acquiring section that acquires measurement data, measured by a measurement device, indicating a state of a natural resource that is a fluid flowing through an extraction network for extracting the natural resource;

a state estimating section that estimates the state of the natural resource at least at one location differing from a location where the measurement device is provided in a flow path of the extraction network, using the measurement data and a model of the extraction network; and a margin calculating section that calculates a margin until flow path blocking matter is generated in the extraction network, based on the estimated state of the natural resource, wherein the state estimating section estimates a pressure and a temperature of the natural resource at each of a plurality of locations in a flow path of the extraction network, and the margin calculating section calculates the margin using the pressures and temperatures at the plurality of locations and a critical curve indicating a relationship of pressure and temperature across which the flow path blocking matter is generated, the critical curve based on a content ratio of a chemical substance for preventing the generation of flow path blocking matter.

2. The apparatus according to claim 1, wherein the data acquiring section acquires the measurement data indicating a state of at least one of the natural resource flowing into the extraction network from a well side and the natural resource flowing out from the extraction network.

3. The apparatus according to claim 1, further comprising:

a determining section that determines a recommended operational amount of an inhibition apparatus that inhibits generation of the flow path blocking matter, based on the margin.

4. The apparatus according to claim 3, further comprising:

a control section that performs control to cause the inhibition apparatus to operate with the recommended operational amount.

5. The apparatus according to claim 3, wherein the inhibition apparatus inhibits the generation of the flow path blocking matter by performing at least one of chemical injection, temperature adjustment of the flow path of the extraction network, and pressure adjustment in the flow path of the extraction network.

6. The apparatus according to claim 1, wherein the flow path blocking matter includes at least one of a hydrate, an asphaltene, wax, and a scale.

7. The apparatus of claim 1, wherein the extraction network is configured to extract the natural resource from a land based oil field.

8. The apparatus of claim 1, wherein the extraction network transports the natural resource from a well on an ocean floor to an offshore facility or to a facility on land.

9. The apparatus of claim 8, wherein:

the well comprises a wellhead; and the wellhead extends from a surface of the ocean floor to a stratum containing the natural resource.

10. The apparatus of claim 8, wherein:

the extraction network comprises at least one pipeline; and the at least one pipeline is installed on the ocean floor.

11. The apparatus of claim 10, wherein the at least one pipeline is at least one flowline.

12. The apparatus of claim 8, wherein:

the extraction network comprises at least one of manifolds or flowlines; and the at least one of manifolds or flowlines are piping structures installed on the ocean floor.

13. The apparatus of claim 12, wherein:

the extraction network comprises at least one riser;

the at least one riser is a pipeline;

the at least one riser has one end on the ocean floor connected to at least one of the manifolds;

the at least one riser is configured to guide the natural resources along the ocean floor to the offshore facility; and the offshore facility comprises legs that are secured to the ocean floor.

14. A method comprising:

acquiring, by a computer, measurement data, measured by a measurement device, indicating a state of a natural resource that is a fluid flowing through an extraction network for extracting the natural resource;

estimating, with the computer, the state of the natural resource at least at one location differing from a location where the measurement device is provided in a flow path of the extraction network, using the measurement data and a model of the extraction network; and calculating, with the computer, a margin until flow path blocking matter is generated in the extraction network, based on the estimated state of the natural resource, wherein estimating the state of the natural resource includes estimating a pressure and a temperature of the natural resource at each of a plurality of locations in a flow path of the extraction network, and calculating the margin includes calculating the margin using the pressures and temperatures at the plurality of locations and a critical curve indicating a relationship of pressure and temperature across which the flow path blocking matter is generated, the critical curve based on a content ratio of a chemical substance for preventing the generation of flow path blocking matter.

15. A non-transitory computer-readable medium storing thereon a program that, when executed by a computer, causes the computer to perform operations comprising:

acquiring measurement data, measured by a measurement device, indicating a state of a natural resource that is a fluid flowing through an extraction network for extracting the natural resource;

estimating the state of the natural resource at least at one location differing from a location where the measurement device is provided in a flow path of the extraction network, using the measurement data and a model of the extraction network; and calculating a margin until flow path blocking matter is generated in the extraction network, based on the estimated state of the natural resource, wherein estimating the state of the natural resource includes estimating a pressure and a temperature of the natural resource at each of a plurality of locations in a flow path of the extraction network, and calculating the margin includes calculating the margin using the pressures and temperatures at the plurality of locations and a critical curve indicating a relationship of pressure and temperature across which the flow path blocking matter is generated, the critical curve based on a content ratio of a chemical substance for preventing the generation of flow path blocking matter.

* * * * *